United States Patent [19]

Frazita

[11] Patent Number: 4,554,551

[45] Date of Patent: Nov. 19, 1985

[54] ASYMMETRIC RESONANT WAVEGUIDE APERTURE MANIFOLD

[75] Inventor: Richard F. Frazita, St. James, N.Y.

[73] Assignee: Hazeltine Corporation, Commack, N.Y.

[21] Appl. No.: 497,350

[22] Filed: May 23, 1983

[51] Int. Cl.[4] ..... H01Q 13/10

[52] U.S. Cl. ..... 343/771; 343/703

[58] Field of Search ..... 343/770, 771, 703

[56] References Cited

U.S. PATENT DOCUMENTS 3,328,800 6/1967 Alceo ..... 343/771

*Primary Examiner*—Eli Lieberman

*Attorney, Agent, or Firm*—E. A. Onders; F. R. Agovino

[57] ABSTRACT

A waveguide manifold for monitoring the operation of an array antenna. The waveguide is centerfed and has reflecting terminations at either end. The waveguide output is matched to the waveguide as if non-reflecting terminations were at either end of the waveguide. The waveguide input is a plurality of groups of slots wherein adjacent groups have alternating phase. Adjacent slots in each group have alternating polarity. A standing wave created in the waveguide has a plurality of cells of alternating phase. Each slot is located within one of the resonating standing wave cells. The resulting manifold beam forming characteristic will be temperature and frequency independent over a practical range.

12 Claims, 14 Drawing Figures

ASYMMETRIC RESONANT WAVEGUIDE APERTURE MANIFOLD

BACKGROUND OF THE INVENTION

1. Field of the Invention

The invention relates generally to phase-stable manifolds and, in particular, a resonant waveguide for monitoring a scanning beam antenna essentially independent of temperature and frequency over a practical range and for monitoring a scanning beam antenna at a scan angle which is not aligned with the boresight direction of the antenna.

2. Description of the Prior Art

Slotted waveguides are sometimes used as aperture manifolds which couple to the radiated signal of a phased-array antenna to monitor its performance. Such waveguide manifolds are used in Microwave Landing System (MLS) ground systems for producing a signal equivalent to a signal viewed by a receiver at a specific angle within the coverage volume of the ground system. Ideally, such waveguide manifolds provide a far-field view of the scanning beam of the ground system and, additionally, measure the antenna insertion phase and amplitude associated with each individual array element.

Waveguide manifolds used to monitor elevation and azimuth scanning beams of an MLS ground system have been waveguides which propagate travelling waves and, consequently, the phasing characteristics are frequency and temperature dependent. The result is that the scan angle of the beam monitored at the waveguide output is also temperature and frequency dependent.

SUMMARY OF THE INVENTION

It is an object of this invention to provide a resonant waveguide aperture manifold that forms a beam at a scan angle that is not perpendicular to the manifold and that is independent of temperature and frequency.

The apparatus according to the invention comprises a transmission line for directing electromagnetic energy in a predetermined frequency range. The line is associated with groups of elements such as coupling slots or holes wherein adjacent groups have different phase. Each group has N elements wherein adjacent elements have different phase, N being a positive integer greater than one.

A transducer is associated with the line for converting energy having a frequency within the predetermined frequency range into an electrical signal having a corresponding frequency and vice versa. The transducer has an impedance which is matched to the line as if the line had non-reflecting terminations coupled to the first and second ends thereof. First means creates a short circuit at the first end of the line and second means creates a short circuit at the second end of the line.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
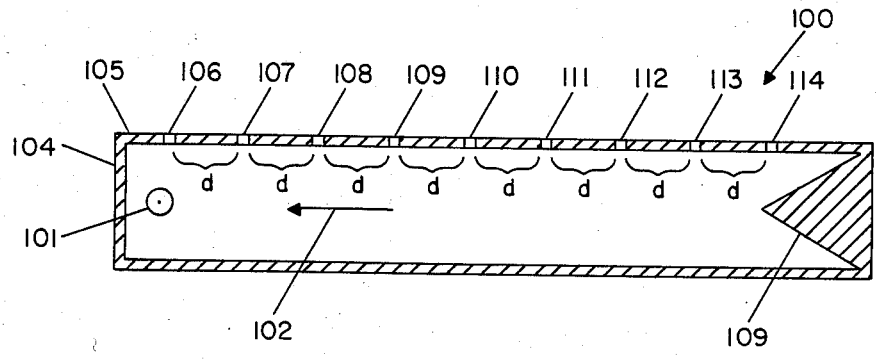
FIG. 1 PRIOR ART
FIG. 1 is a longitudinal cross-sectional view of a travelling waveguide according to the prior art.

As shown in FIG. 1, a prior art travelling wave manifold 100 made of conductive material is provided with an output transducer such as connector 101 which receives a wave propagating along propagation path 102 which is terminated in absorber 109 or other non-reflecting terminating means at the far end. Side 104 functions as a short circuit which reflects waves propagating to the left. Side 105 of waveguide 100 is provided with weakly coupled input slots 106, 107, 108, 109, 110, 111, 112 and 113 having spacing d. The phase relationship between adjacent slots 106 and 107 is given by the following formula:

$$\phi_{107}=\phi_{106}+(2\pi/\lambda g)d\pm\pi$$

As shown by the formula, the phase of slot 107 ($\phi_{107}$) as compared to the phase of slot 106 ($\phi_{106}$) is dependent upon the spacing d and the waveguide wavelength ($\lambda_g$). All other adjacent slots have similar phase relationships. Since spacing d is temperature dependent (conductive material such as copper or aluminum expands or contracts with temperature variations) and the waveguide wavelength $\lambda_g$ is frequency dependent, travelling wave manifold 100 is both frequency and temperature dependent.

The monitored beam pointing angle, $\theta$, for the travelling wave manifold having slots of alternating phase is defined as the pointing angle of a beam provided at the manifold output connector as a result of excitations imparted at the manifold slots. By reciprocity, it may be defined as the conjugate of the pointing angle of a beam radiated by the manifold output slots as a result of excitations imparted by the manifold input connector. The monitored beam pointing angle is given by:

$$\theta = \arcsin\left[\sqrt{1-\left(\frac{\lambda_o}{\lambda_{co}}\ \frac{f_o}{f}\right)^2} - \frac{\lambda_o}{2d}\ \frac{f_o}{f}\right]$$

where $\lambda_o$=reference free space wavelength (design center)

Figure 2:
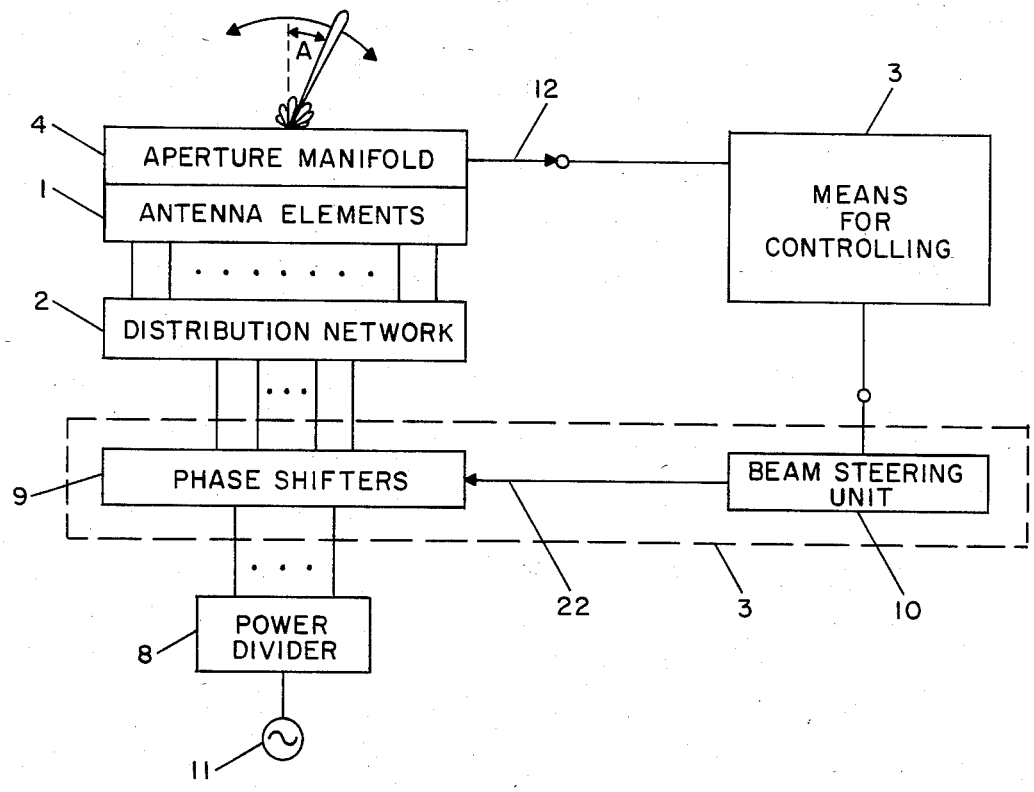
FIG. 2 is a simplified block diagram illustrating one use of an aperture manifold as described in copending application Ser. No. 415,057 filed Sept. 7, 1982 for Scanning Antenna With Automatic Beam Stabilization, incorporated herein by reference.

$\lambda_{co}$=waveguide cutoff wavelength $f_o$=reference frequency f=frequency of excitations This equation gives the explicit relationship between the monitored beam pointing angle, frequency and coupling slot spacing. The invention relates to: (a) microwave landing systems which use wide scanning phased array antenna systems having a sharp cutoff of the element pattern, such as are disclosed by Richard F. Frazita, Alfred R. Lopez and Richard J. Giannini in U.S. Pat. No. 4,041,501; (b) calibration of a system having plural signal carrying channels as disclosed in Ser. No. 06/497,348, now U.S. Pat. No. 4,520,361, filed concurrently herewith and invented by R. F. Frazita; and (c) resonant waveguide aperture manifolds as disclosed in Ser. No. 06/497,349 filed concurrently herewith and invention by A. R. Lopez; each is assigned to Hazeltine Corporation and is incorporated herein by reference. Referring to FIG. 2, generally such antenna systems include one or more radiating elements forming an array 1 in which the elements are arranged along an array axis and are spaced from each other by a given distance. Each of the elements is coupled to a power divider 8 via a corresponding one of a plurality of phase shifters 9 connected to the elements by distribution network 2. Wave energy signals from signal generator 11 and power divider 8 are supplied to antenna elements 1 by phase shifters 9 such that a proper selection of the relative phase values for phase shifters 9 causes antenna elements 12 to radiate a desired radiation pattern into a selected angular region of space. Variation of the relative phase values of the phase shifters 9 is accomplished by beam steering unit 10 via control line 22 and causes the radiated antenna pattern to change direction with respect to angle A in space. Therefore, phase shifters 9 and beam steering unit 10 together form means 2 for scanning a beam radiated by the antenna elements of array 1 as a result of the supplied wave energy signals from generator 11 coupled to the elements of array 1 by power divider 8 and distribution network 2.

The properties of a scanning antenna and techniques for selecting design parameters such as aperture length, element spacing and the particular configuration of the distribution network 2 are well known in the prior art. A review of these parameters is completely described in U.S. Pat. No. 4,041,501.

In order to stabilize the beam pointing angle of the radiated beam, an aperture manifold 4 is associated with the antenna elements of array 1. Manifold 4 may be any means for forming a signal provided by output 12 which represents a beam pointing angle of the radiated beam. Preferably, manifold 4 is a highly phase stable waveguide or manifold, such as the invention, coupled to the array 2 and center-fed to avoid inherent frequency (phase) and temperature effects. Center feeding also eliminates first-order dependence on frequency and absolute temperature variations.

As used herein, manifold 4 refers to any type of device for sampling signals including a waveguide, a printed circuit network, a coaxial line network or a power combiner. A phase stable manifold is, by definition, one in which the beam formed by summing of the slot excitations is insensitive to frequency and temperature changes and is used in combination with a phased array in accordance with this invention to detect bias error at a specific angle. Manifold 4 is equivalent in function to a probe located in space at a specific angle with respect to the phased array. A manifold in accordance with the present invention may be a slotted waveguide configured to monitor radiated energy such that there is equal, non-zero phase and equal amplitude at all sample points (i.e. slot locations) of the manifold.

The output 12 of manifold 4 is coupled to means 5, associated with means 3, for controlling the scanning of the radiated beam in response to the output 12 of manifold 4.

Figure 3:
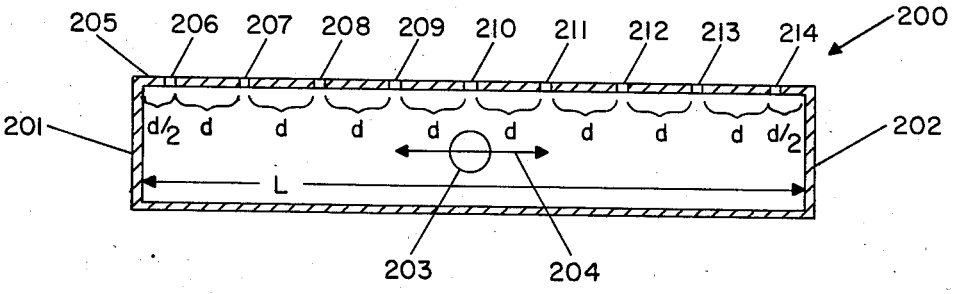
FIG. 3 is a longitudinal cross-sectional view of a resonant waveguide according to the invention.
Figure 4:
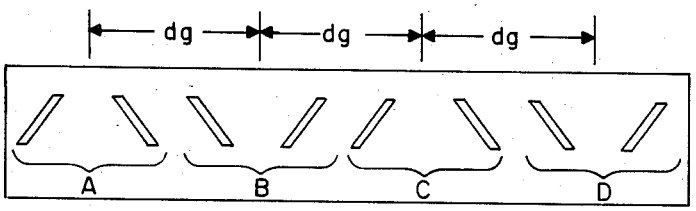
FIG. 4 is a perspective view of one side of a resonant waveguide according to the invention showing the adjacent groups of slots of alternating phase wherein each group has adjacent slots of alternating phase.
Figure 5:
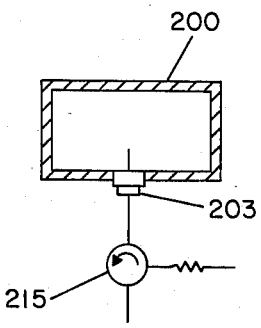
FIG. 5 is a transverse cross-sectional view of one resonant waveguide according to the invention illustrating its rectangular configuration.
Figure 6:
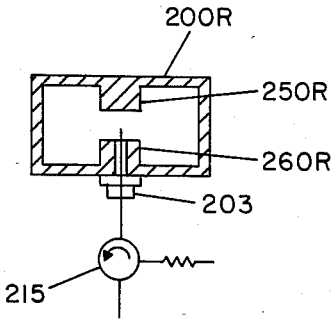
FIG. 6 is a transverse cross-sectional view of another resonant waveguide according to the invention illustrating its ridged rectangular configuration.

FIG. 3 illustrates a resonant waveguide 200 according to the invention. Waveguide 200 is provided with a first end 201 terminating in a short circuit such as a conductive sheet of metal perpendicular to the sides of waveguide 200 and a second end 202 terminating in a short circuit. Waveguide 200 is center fed by a transducer which converts an electrical signal into electromagnetic energy and vice versa. Preferably, the transducer is any connector well known in the prior art such as output connector 203 which receive waves propagating in both directions along path 204. Side 205 of waveguide 200 is provided with slots 206, 207, 208, 209, 210, 211, 212, 213, and 214 for coupling to a radiating antenna. FIG. 4 illustrates a 180° degree phase compensating pattern of the coupling slots which will be described below. FIGS. 5 and 6 illustrate preferred rectangular crossections of waveguide 200.

Figure 7:
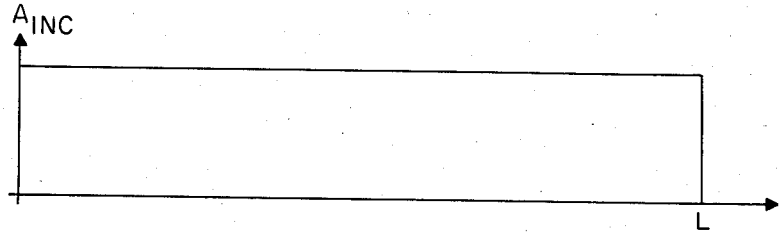
FIG. 7 is an amplitude diagram of an incident wave propagating within a waveguide according to the invention.

As shown by FIG. 7, an incident wave radiated by connector 203 has a constant amplitude $A_{inc}$ along the entire length of waveguide 200. This is because amplitude tapers in the travelling wave caused by the coupling slots is counteracted and eliminated by the resonance of waveguide 200.

Due to reciprocity, waveguide 200 may be used in either a transmitting or receiving mode. In the transmitting mode, connector 203 is connected via isolator 215 to a signal source (not shown). The signal is converted by connector 203 to electromagnetic wave energy which propagates along waveguide 200 and is radiated by slots 206–214. In the receiving mode, slots 206–214 are illuminated by electromagnetic wave energy which propagates along waveguide 200 and is converted by connector 203 into an electrical signal. For convenience and according to convention, the invention has been described in a receiving mode. However, the claims are directed to an apparatus for radiating signals.

Figure 8:
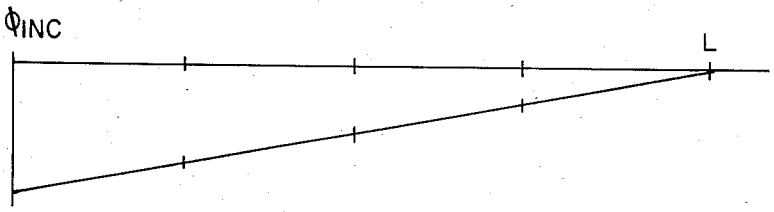
FIG. 8 is a phase diagram of an incident wave propagating within a waveguide according to the invention.

FIG. 8 is an illustration of the incident phase $\phi_{inc}$ of the wave radiated by connector 203 and illustrates that the phase along waveguide 200 is linearly changing.

Figure 9:
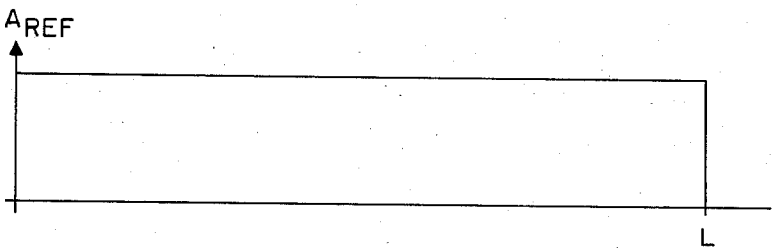
FIG. 9 is an amplitude diagram of a reflected wave propagating within a waveguide according to the invention.
Figure 10:
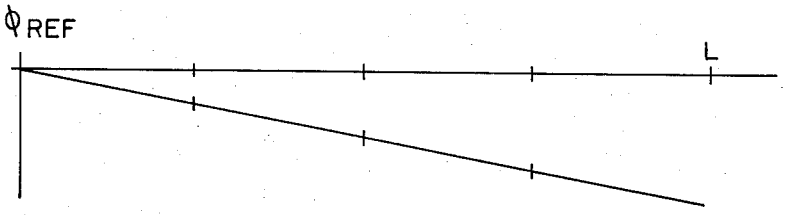
FIG. 10 is a phase diagram of a reflected wave propagating within a waveguide according to the invention.
Figure 11:
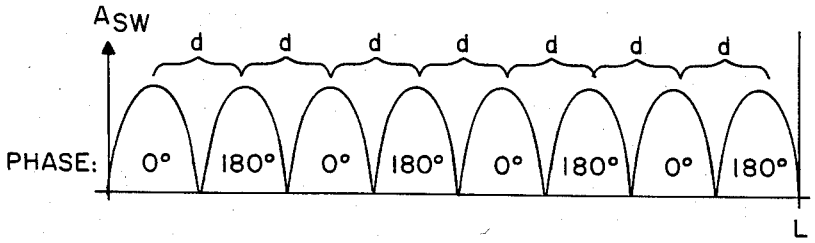
FIG. 11 is a diagram of the standing wave generated within a resonant waveguide according to the invention.

Since short circuits 201 and 202 reflect the incident waves propagating within waveguide 200, FIG. 9 illustrates that the amplitude of the reflected wave $A_{ref}$ is constant along the entire length of waveguide 200. Similarly, the phase of the reflected wave $\phi_{ref}$ propagating within waveguide 200 is linearly changing with distance. The result, as illustrated in FIG. 11, is a standing wave having a plurality of cells of alternating phase of zero degrees and 180 degrees between spacing d of the slots.

As shown in FIG. 4, each slot is located within one of the standing wave cells of waveguide 200. By alternating the direction and thereby the phase of the slots, the resulting manifold output will have equal phase for each coupling slot and will be temperature and frequency independent as long as the variations in temperature and frequency are within the range such that there is one and only one slot or group of slots located within each standing wave cell. By alternating the direction and thereby the phase of each group A, B, C and D of slots (N=2) and by alternating direction and thereby the phase of adjacent slots within each group, the resulting manifold output will approximate an 11.25° beam pointing angle. This aperture manifold provides a beam forming capability which is independent of frequency and temperature since the phase within each standing wave cell is constant. To prevent transmission of the reflected wave back through connector 203, isolator 215 is located within the line feeding connector 203.

The monitored beam pointing angle, $\theta$, for resonant manifold 200 according to the invention, over the operational frequency bandwidth, is given by:

$$\theta = \arcsin(0.5/dg/\lambda)$$

where dg is the group spacing. Therefore, the phasing of manifold 200 is independent of frequency and coupling slot spacing over the operational frequency bandwidth. Furthermore, the beam pointing angle is generally not 0° and the beam radiated by manifold 200 is not perpendicular to path 204 because of the nonequal phasing of the groups of slots. For example, an MLS ground system having a center operating frequency of 5.06 GHz (i.e. $\lambda$=2.33 inches) and a group spacing (dg) of 5.97" would have a monitored beam pointing angle of 11.25°.

In order to achieve the results described above, input connector 205 is initially matched to waveguide 200 as if each end of waveguide 200 terminated in a non-reflecting absorber as shown in the prior art illustrated in FIG. 1. Such a matched connector 205 is employed with waveguide 200 terminating in short circuits as illustrated in FIG. 2 thereby resulting in the resonant standing wave as shown in FIG. 9.

To achieve the in-phase condition of the adjacent coupling slots of waveguide 200, the required waveguide wavelength $\lambda g$ is twice the spacing d between coupling slots 206–214. This spacing d is determined by the radiating characteristics of the phased array antenna associated with waveguide 200 and is typically slightly larger than ½ wavelength. For the Microwave Landing System elevation phased array antenna, ridge loading as shown in FIG. 6 is used to obtain this result. In particular, opposing ridges 250R and 260 R are located within waveguide 200R for eliminating odd mode resonance which may disturb the amplitude and phase of the slot excitations.

The maximum length, L, of a manifold according to the invention is limited by the operational frequency bandwidth of the phased array antenna with which it is associated. To limit the beam distortions caused by amplitude taper at the band edges, length L should not exceed the value given below:

$$L \leq \frac{\lambda_o}{2} \frac{f_o}{f_{max}\sqrt{1-\left(1-\frac{\lambda_o f_o}{\lambda_{co} f_{max}}\right)^2} - f_{min}\sqrt{1-\left(1-\frac{\lambda_o f_o}{\lambda_{co} f_{min}}\right)^2}}$$

For the ICAO standard Microwave Landing System bandwidth, L is given approximately by:

$$L \approx (\lambda g\, fo/2\Delta f)$$

where $\Delta f/fo$ is the fractional design bandwidth plus a margin for fabrication tolerances. For $\Delta f/fo$=0.0165, L=30.3 $\lambda g$. For larger arrays on the order of 60 $\lambda g$, two similar manifolds can be interconnected with equal length stable transmission lines.

Figure 12:
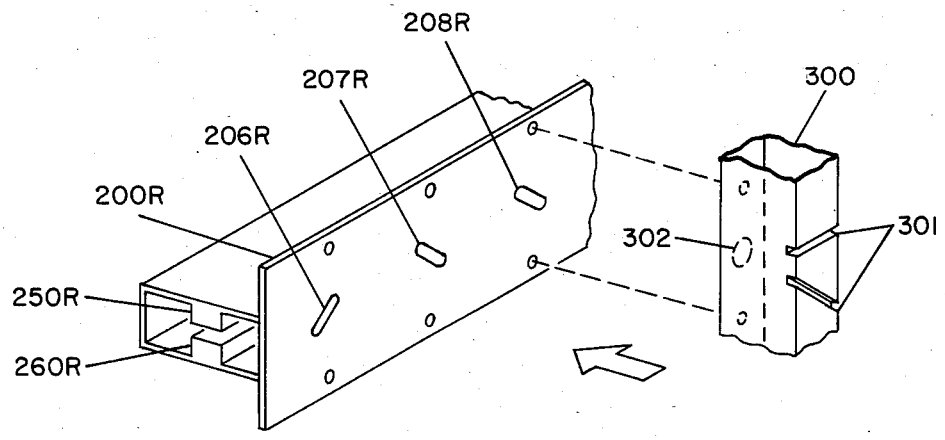
FIG. 12 is one illustration of the resonant waveguide according to the invention coupled by means of slots to the radiating waveguide column of an MLS azimuth antenna.

FIG. 12 illustrates waveguide 200R in association with waveguide 300 such as described by U.S. Pat. No. 3,903,524, incorporated herein by reference, owned by Hazeltine Corporation, the assignee of the present invention. Waveguide 300 may be one of a series of parallel waveguides forming the azimuth antenna of a Microwave Landing System (MLS) ground system. Such a ground system requires monitoring to evaluate its performance. In order to provide such monitoring, waveguide 200R functions as a manifold and is associated with each of the parallel waveguides 300. Ridge loading in waveguide 200R in the form of ridges 250R and 260R is used to match the guide wavelength of waveguide 200 to the required spacing of radiating waveguides 300. Specifically, waveguide 300 with polarized radiating slots 301 has a non-polarized opening 302 coupled to slot 208R. Other vertical waveguides would be coupled to slots 206R and 207R.

Figure 13:
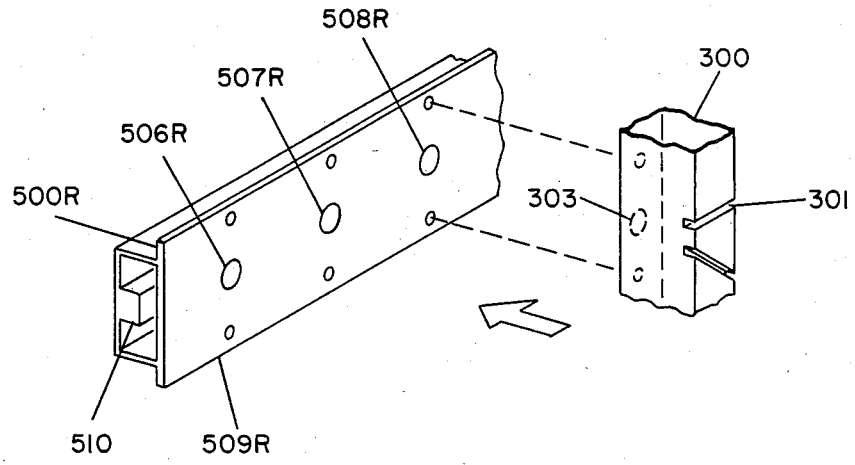
FIG. 13 is another illustration of a resonant waveguide according to the invention coupled by means of holes to the radiating waveguide column of an MLS azimuth antenna.

FIG. 13 illustrates another MLS ground system coupling configuration having non-polarized holes 506R, 507R and 508R in braod wall 509R of waveguide 500R and having ridge 510R on broad wall 511R. The non-polarized holes are coupled to parallel radiating waveguides such as waveguide 300 by polarized slot 303. For this configuration the required 180 degree phase reversals between adjacent coupling holes is incorporated in the design of waveguide 300. Adjacent waveguides 300 have a 180° phase reversal at their input wave launchers i.e. slot 303.

Figure 14:
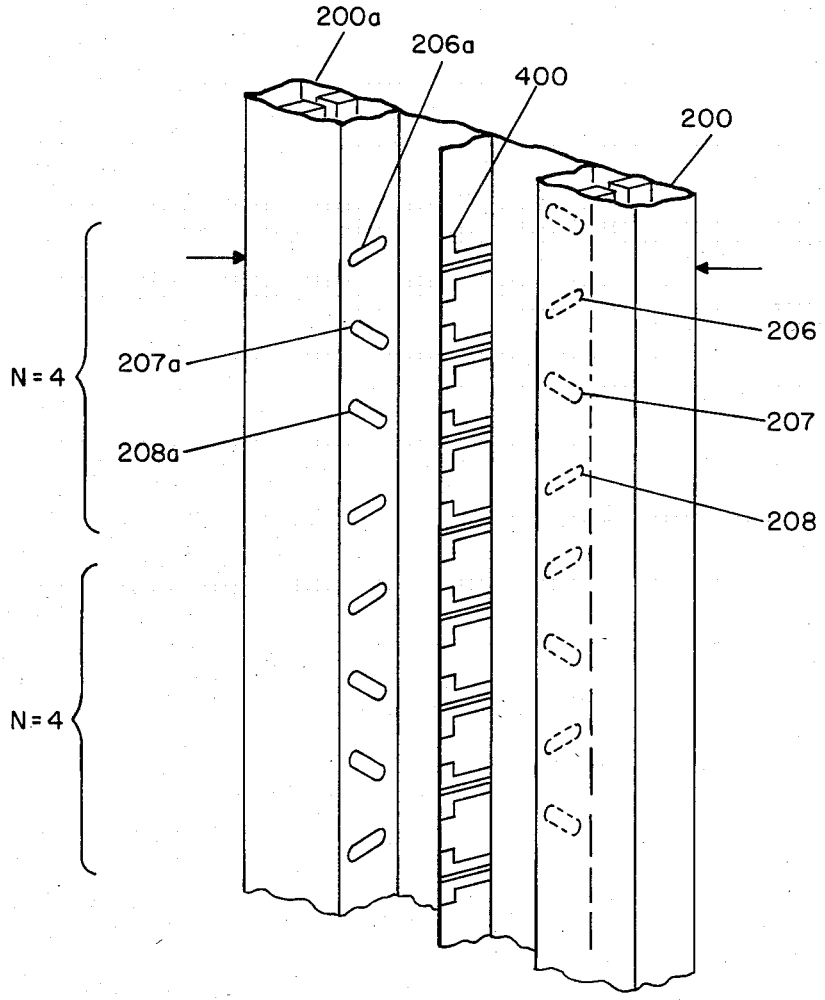
FIG. 14 is an illustration of a resonant waveguide according to the invention coupled by means of slots to the radiating waveguide column of an MLS elevation antenna.

FIG. 14 illustrates another MLS ground system coupling configuration wherein slots 206, **206*a*, 207, 207*a*, 208, 208*a*, are coupled to dipole array 400** which may function as an MLS elevation antenna. Although this invention has been particularly described with regard to its function as an elevation manifold, it may be used as an azimuth manifold or other array monitor.

While there have been described what are at present considered to be the preferred embodiments of this invention, it will be obvious to those skilled in the art that various changes and modifications may be made therein without departing from the invention and it is, therefore, aimed to cover all such changes and modification as fall within the true spirit and scope of the invention.

What is claimed is:

1. An apparatus for monitoring radiated signals, said apparatus comprising:

(a) a transmission line for directing electromagnetic energy in a predetermined frequency range, said line having first and second ends;

(b) means for sampling the radiated signals, said means including groups of elements associated with said line wherein adjacent groups have different phase, each group having N elements wherein adjacent elements within each group have different phases, where N is a positive even integer greater than one;

(c) a transducer associated with said line for converting energy having a frequency within the predetermined frequency range into an electrical signal having a corresponding frequency;

(d) said transducer having an impedance which is matched to said line as if said line had substantially non-reflecting terminations coupled to the first and second ends thereof;

(e) first means for creating a short circuit at the first end of said line; and (f) second means for creating a short circuit at the second end of said line whereby said transducer is not impedance-matched to said first and seconds means so that the transducer output is independent of changes in temperature and frequency within the desired frequency range.

2. The apparatus of claim 1 wherein said transmission line comprises an electrically conductive hollow member and said elements comprise openings in said member.

3. The apparatus of claim 2 wherein said electrically conductive hollow member is a linear waveguide of rectangular cross-section and said openings comprise a linear array of slots spaced apart by sutstantially one-half of the waveguide wavelength of said member.

4. The apparatus of claim 3 wherein said transducer comprises a connector projecting into said member.

5. The apparatus of claim 4 further including means for isolating from the member any load connected to the connector.

6. The apparatus of claim 4 wherein said first means comprises a first electrically conductive member substantially perpendicular to the sides of said waveguide and attached to the first end and said second means comprises a second electrically conductive member substantially perpendicular to the sides of said waveguide and attached to the second end, and said slots are configured to approximate a beam pointing angle of approximately 11.25°.

7. The apparatus of claim 6 wherein adjacent groups of elements have opposite phases and adjacent elements within each group have opposite phases.

8. The apparatus of claim 1 further including means for eliminating odd mode resonance thereby reducing amplitude and phase distortions of the element excitations.

9. The apparatus of claim 8 wherein said transmission line comprises an electrically conductive hollow member and said elements comprise openings in said member.

10. The apparatus of claim 9 wherein said means for eliminating comprises a ridge located within said member.

11. The apparatus of claim 10 wherein said openings are configured to approximate a beam pointing angle of approximately 11.25°.

12. The apparatus of claim 11 wherein adjacent groups of elements have opposite phases and adjacent elements within each groups have opposite phases.

* * * * *